United States Patent [19]

Trä

[11] 4,197,193

[45] Apr. 8, 1980

[54] APPARATUS FOR CLASSIFYING THE CONSTITUENTS OF DILUTE SUSPENSIONS OF FIBERS

[75] Inventor: Josef Trä, Heidenheim, Fed. Rep. of Germany

[73] Assignee: J. M. Voith GmbH, Heidenheim, Fed. Rep. of Germany

[21] Appl. No.: 940,185

[22] Filed: Sep. 7, 1978

Related U.S. Application Data

[63] Continuation-in-part of Ser. No. 733,086, Oct. 18, 1976, abandoned.

[30] Foreign Application Priority Data

Oct. 21, 1975 [DE] Fed. Rep. of Germany ..... 333550

[51] Int. Cl.[2] ..... B04C 5/28

[52] U.S. Cl. ..... 209/211; 210/512 M

[58] Field of Search ..... 209/144, 211; 55/346–349; 210/512 R, 512 M

[56] References Cited

U.S. PATENT DOCUMENTS

| | | | |
|---|---|---|---|
| 2,622,735 | 12/1952 | Criner | 209/211 |
| 2,717,536 | 9/1955 | Clark et al. | 209/211 |
| 3,401,506 | 9/1968 | Burdock | 209/144 X |
| 3,598,731 | 8/1971 | Frykhult et al. | 210/512 M X |
| 3,862,041 | 1/1975 | Robinson | 55/349 X |
| 3,959,123 | 5/1976 | Wikdahl | 209/211 |

FOREIGN PATENT DOCUMENTS

| | | | |
|---|---|---|---|
| 641422 | 5/1962 | Canada | 55/346 |
| 1078998 | 4/1960 | Fed. Rep. of Germany | 210/512 M |

*Primary Examiner*—Ralph J. Hill

*Attorney, Agent, or Firm*—Peter K. Kontler

[57] ABSTRACT

Apparatus for segregation of fibers from a suspension which contains relatively heavy contaminants has two elongated parallel but not coaxial horizontal vessels which are welded or strapped together and one of which is located below the other. One end of the lower vessel is connected with a pipe which admits the suspension and the other end of the upper vessel is connected with a pipe for evacuation of segregated fibers. The vessels have openings for portions of at least one row of discrete centrifugal separators each having a tangential inlet for suspension which communicates with the first vessel, an upwardly extending first outlet which discharges fibers into the upper vessel, and a downwardly extending second outlet for impurities. Each separator is detachable from and reattachable to both vessels.

13 Claims, 13 Drawing Figures

APPARATUS FOR CLASSIFYING THE CONSTITUENTS OF DILUTE SUSPENSIONS OF FIBERS

CROSS-REFERENCE TO RELATED APPLICATION

This is a continuation-in-part of my copending application Ser. No. 733,086 filed Oct. 18, 1976 now abandoned.

BACKGROUND OF THE INVENTION

The present invention relates to apparatus for segregating lighter fractions from heavier fractions of suspensions of such fractions in water or another liquid carrier. More particularly, the invention relates to apparatus which can be used with advantage to separate fibers from heavier contaminants in suspensions which contain the constituents of waste paper or the like. Still more particularly, the invention relates to improvements in apparatus wherein the segregation of lighter fraction from heavier fraction is effected by several centrifugal separators of the type known as hydrocyclones, centricleaners, vortex pressure drop type cleaners, tubular gravity separators and conical gravity separators.

It is already known to treat the constituents of a suspension in an apparatus wherein two or more centrifugal separators with tangential inlets for suspension receive the suspension from a first chamber and discharge the lighter fraction into a second chamber. The heavier fraction is evacuated by way of centrally located outlets of the separators. Reference may be had to German Utility Model No. 1,932,636 which discloses a single vessel with a first chamber which feeds the suspension to the tangential inlets of several separators and a second chamber which receives the lighter fraction from upwardly extending outlets of the separators. The vessel is a one-piece casting. Such castings can be produced at a reasonable cost only in relatively small sizes so that the output of apparatus utilizing vessels of the type disclosed in the German Utility Model is relatively low.

German Pat. No. 1,517,945 discloses a modified apparatus wherein the conical housings of several hydrocyclones are attached to the bottom wall of a first chamber which receives the suspension at elevated pressure. The centrally located outlets of the hydrocyclones extend upwardly through the first chamber and discharge the lighter fraction into a second chamber above the first chamber. These outlets are permanently affixed to the bottom of the second chamber. A drawback of the patented apparatus is that the cyclones cannot be detached from the chambers.

OBJECTS AND SUMMARY OF THE INVENTION

An object of the invention is to provide a novel and improved apparatus which can process large quantities of suspension per unit of time, whose dimensions can greatly exceed the dimensions of heretofore known apparatus, which can be produced at a relatively low cost, and wherein all such parts which require frequent inspection, repair or replacement can be readily detached from other parts.

Another object of the invention is to provide a novel array of vessels for use in the above outlined apparatus.

An additional object of the invention is to provide an apparatus which can utilize known centrifugal separators.

A further object of the invention is to provide an apparatus which, even though of lightweight construction, can readily withstand elevated pressures of the processed material.

An ancillary object of the invention is to provide a novel and improved apparatus for classification of the constituents of suspensions of waste paper or the like.

The invention is embodied in an apparatus for segregating lighter and heavier fractions of a suspension, particularly for segregating relatively light fibers from heavier impurities. The apparatus comprises substantially parallel first and second elongated vessels the first of which is preferably located at a level below the second vessel and the second of which can be recessed into the first vessel, either entirely or in part, weldants, straps or other suitable means for connecting the vessels to each other, one or more pipes for admitting the suspension into the first vessel at an elevated pressure, preferably at one end of the first vessel, at least two discrete centrifugal separators each of which has a substantially tangential inlet for suspension which communicates with the first vessel, a first outlet for the lighter fraction in communication with the second vessel, and a preferably centrally located second outlet for the heavier fraction (such second outlets discharge the heavier fraction into a collecting pipe outside of the first chamber), means for evacuating the lighter fraction from the second vessel, and screw threads or other suitable means for detachably securing the separators to the vessels.

Each vessel may constitute an elongated cylinder having a circular or polygonal cross-sectional outline, a hollow cone or a hollow pyramid. The vessels preferably consist of sheet metal and the first vessel is preferably constructed and assembled to withstand internal pressures higher than those which can be withstood by the second vessel. The axes of the vessels are preferably parallel to each other but do not coincide.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
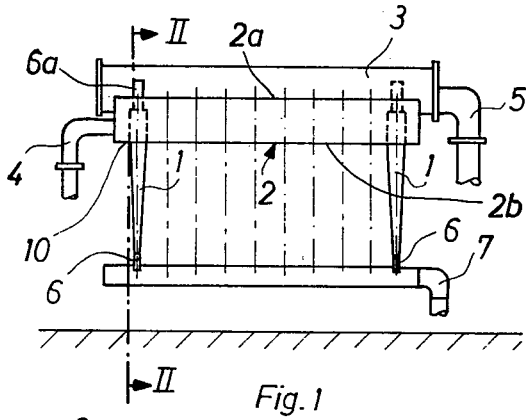
FIG. 1 is a schematic side elevational view of an apparatus which embodies one form of the invention and comprises a single row of separators.
Figure 2:
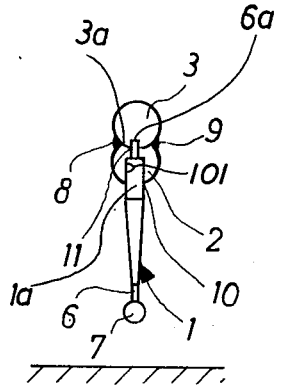
FIG. 2 is a schematic transverse vertical sectional view as seen in the direction of arrows from the line II—II of FIG. 1.

Referring to FIGS. 1 and 2, there is shown a first apparatus which comprises a first or lower vessel or tank 2, a second or upper vessel or tank 3, a pipe 4 which admits a suspension of pulp and heavier impurities into one end of the vessel 2, a pipe 5 which evacuates pulp from one end of the upper vessel 3, and a battery of upright conical centrifugal separators 1 each of which is detachably secured to the vessels 2 and 3. The vessels 2 and 3 are elongated horizontal hollow cylinders which consist of sheet metal and whose axes are parallel or nearly parallel to but spaced apart from each other. The pipe 4 feeds the suspension into that end of the vessel 2 which is remote from the inlet of the evacuating pipe 5. The separators 1 form a single row and each thereof has a centrally located outlet 6 which admits separated impurities into a collecting pipe 7. Each separator 1 is further provided with a customary tangential inlet 101 (see FIG. 2) which communicates with the interior of the lower vessel 2 and receives a continuous stream of suspension which is admitted via pipe 4. Furthermore, each separator 1 comprises an upwardly extending outlet 6*a* which discharges pulp into the interior of the upper chamber 3 whence the material is evacuated via pipe 5.

The upper portion of the cylindrical wall of the lower vessel has a cutout 2*a* which extends all the way between the two end walls of the vessel 2 and receives the lower portion 3*a* of the upper vessel 3. The means for connecting the vessels 2 and 3 to each other comprises seams 8 and 9 of weldant. The lower portion 3*a* of the vessel 3 has a row of openings 11 which receive the outlets 6*a* of the separators 1, and the lower portion 2*b* of the chamber 2 has a row of openings 10 which receive the cylindrical upper portions 1*a* of the housings or barrels of the separators. The portions 1*a* and the outlets 6*a* are provided with external threads (see FIG. 6) which form part of the means for detachably securing the separators 1 to the vessels 2 and 3. The openings 10 and 11 are tapped bores (see FIG. 7) and the threads in such bores mate with the external threads of the portions 1*a* and 6*a* of the respective separators.

The upper vessel 3 is but need not be longer than the lower vessel 2.

It is clear that the mating threads of the separators 1 and vessels 2, 3 constitute but one form of means for separably or detachably securing the separators to the vessels. For example, only the portions 1*a* may be provided with external threads to mate with the threads in the openings 10 whereas the outlets 6*a* simply extend into the openings 11 without any threaded connection between such outlets and the vessel 3. Furthermore, the securing means may comprise quick-release connections of any known design, e.g., bayonet connections or others. All that counts is to insure that each discrete separator 1 can be rapidly and conveniently attached to the vessel 2 and/or 3 in such a way that its tangential inlet receives suspension from the vessel 2 and its outlet 6*a* can discharge the separated lighter fraction into the vessel 3. The number of separators 1 can greatly exceed the number (ten) which is shown in FIG. 1.

The operation:

The pipe 4 supplies a continuous stream of suspension at a pressure which suffices to fill or nearly fill the interior of the vessel 2 and to cause streamlets of suspension to enter the tangential inlets 101 of the entire battery of separators 1. Such inlets are provided in the separator portions 1*a*, i.e., in those portions which are located at a level above the respective openings 10 of the vessel 2. The separators 1 cause the development of high-velocity vortices whereby the heavier fraction travels downwardly along the internal surfaces of the conical housings and is evacuated by way of the outlets 6 which dischage into the collecting pipe 7. The lighter fraction is caused to move to the center of each vortex and is discharged through the respective outlet 6*a* to enter the upper vessel 3. The contents of the vessel 3 are evacuated by way of the pipe 5.

Figure 3:
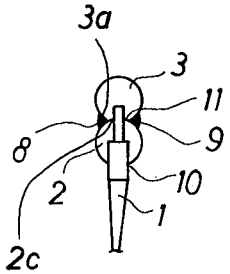
FIG. 3 is a similar schematic transverse vertical sectional view of a second apparatus.

FIG. 3 shows a portion of a second apparatus. The cutout is provided in the lower portion 3*a* of the upper vessel 3 and receives the upper portion 2*c* of the lower vessel 2. The cutout in 3*a* extends all the way between the two end walls of the vessel 3. In this apparatus, the openings 11 (only one shown in FIG. 3) are provided in the upper portion 2*c* of the lower vessel 2. In all other respects, the apparatus of FIG. 3 is assumed to be identical with the apparatus of FIGS. 1 and 2. In each of FIGS. 1 to 3, the diameter of the vessel 2 is identical with or closely approximates that of the vessel 3. However, it is equally possible to employ two vessels having different diameters and/or cross-sectional outlines (see FIG. 13).

Figure 4:
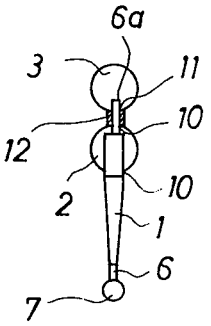
FIG. 4 is a similar schematic transverse vertical sectional view of a third apparatus.

In the apparatus of FIG. 4, the vessels 2 and 3 are connected to each other by distancing members 12. At least a portion of each distancing member 12 may consist of rubber or another suitable elastomeric material. The distancing members 12 may alternate with the outlets 6*a* of the separators 1, or each distancing member may surround an outlet 6*a*.

Figure 5:
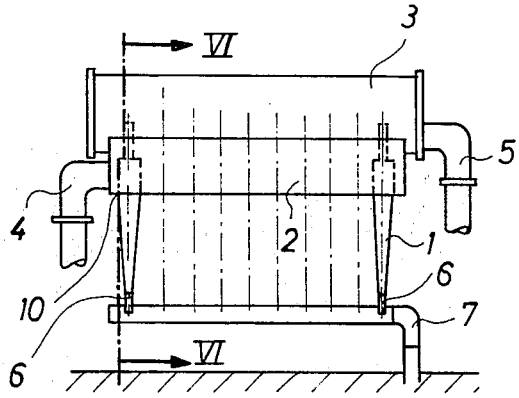
FIG. 5 is a schematic side elevational view of a fourth apparatus.
Figure 6:
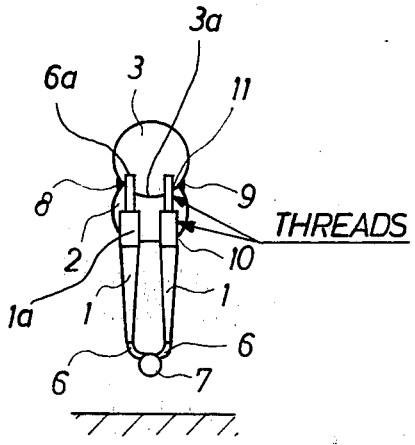
FIG. 6 is a schematic transverse vertical sectional view as seen in the direction of arrows from the line VI—VI of FIG. 5.

The apparatus of FIG. 5 and 6 comprises two rows of separators 1. Otherwise, this apparatus resembles or is identical with the apparatus of FIGS. 1 and 2. The lower end portions of the outlets 6 of the separators 1 are suitably curved so that they discharge into a single collecting pipe 7.

Figure 7:
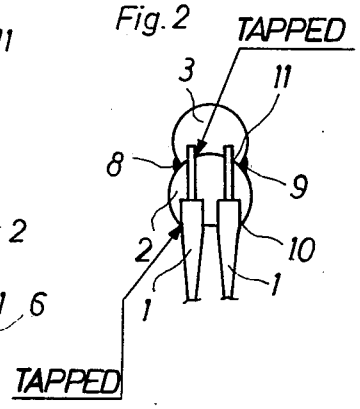
FIG. 7 is a schematic transverse vertical sectional view of a fifth apparatus with two rows of separators.

The apparatus of FIG. 7 also comprises two rows of separators 1 and is otherwise analogous to the apparatus of FIG. 3, i.e., the upper portion of the lower vessel 2 extends into the lower part of the interior of the upper vessel 3.

Figure 8:
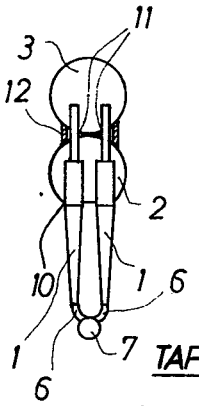
FIG. 8 is a similar schematic transverse vertical sectional view of a sixth apparatus which constitutes a modification of the apparatus of FIG. 7.

The apparatus of FIG. 8 is analogous to the apparatus of FIG. 4. It comprises two rows of separators 1 and the vessels 2, 3 are connected to each other by one or more rows of distancing members 12.

Figure 9:
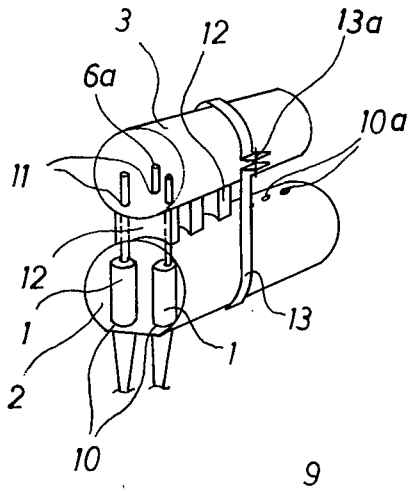
FIG. 9 is a perspective view of a seventh apparatus.

FIG. 9 shows a further apparatus wherein the vessels 2 and 3 are connected to each other by distancing members 12 and one or more straps 13 and fasteners 13*a*. The straps 13 may consist of steel or another suitable metallic material. Similar straps can be used in other embodiments of the apparatus. The apparatus of FIG. 9 comprises two rows of centrifugal separators 1 (only one separator of each row is actually shown in FIG. 9). The reference character 10*a* denotes openings which are provided in the upper portion of the vessel 2 for the outlets 6*a*.

Figure 10:
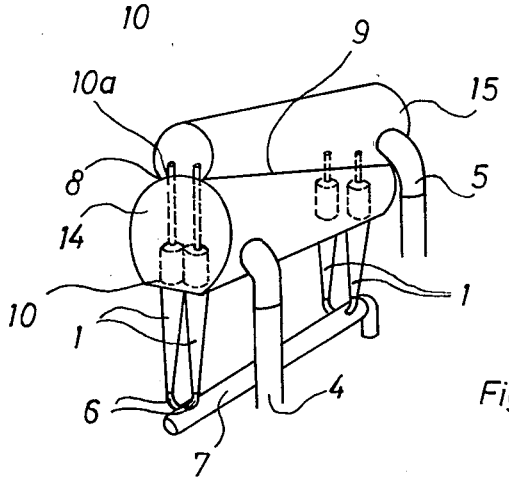
FIG. 10 is a similar perspective view of an eighth apparatus.

The apparatus of FIG. 10 comprises a lower vessel 14 which tapers in a direction from the pipe 4 toward the other end, and an upper vessel 15 which tapers in the opposite direction, i.e., from the pipe 5. The apparatus comprises two rows of centrifugal separators 1 whose outlets 6 discharge the heavier fraction into a common collecting pipe 7. The vessels 14, 15 may constitute truncated cones or truncated pyramids and may be welded (as at 9), strapped and/or otherwise connected to each other. The taper of the vessel 14 may but need not be identical with the taper of the vessel 15. In the embodiment of FIG. 10, a portion of the vessel 14 extends into the vessel 15.

An advantage of the apparatus of FIG. 10 is that it provides more room at the discharge end of the pipe 4 (in the left-hand portion of the lower vessel 14) and at the intake end of the pipe 5 (in the right-hand portion of the upper vessel 15). Consequently, the dimensions of the two vessels can be greatly reduced without affecting the operation of the apparatus because the configuration of both vessels conforms to the normal distribution of liquid therein. Thus, the lower vessel 14 will invariably contain larger quantities of suspension in the region of the pipe 4, and the upper vessel 15 will invariably contain larger quantities of separated lighter fraction in the region of the pipe 5.

Figure 11:
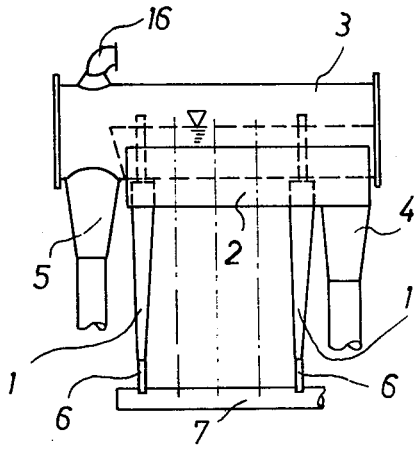
FIG. 11 is a schematic side elevational view of still another apparatus.

The apparatus of FIG. 11 is similar to the apparatus of FIGS. 1–2 or 5–6 (i.e., it can comprise one or more rows of discrete separators 1). In addition, the upper vessel 3 is provided with means for evacuating gases from its interior. Such evacuating means comprises a suction pipe 16 which is connected with a fan or the like, not shown. The pipe 16 communicates with the upper vessel 3 at that end of this vessel which is remote from the pipe 4 and is adjacent to the pipe 5.

Similar means for evacuating gases can be provided in other embodiments of the improved apparatus.

The lower vessel of each embodiment of the apparatus can be constructed and assembled in such a way that it can stand pressures which are much higher than those in the interior of the upper vessel. This can be achieved by appropriate selection of the material and/or wall thickness of the lower vessel. As mentioned above, the material of the vessels is preferably sheet metal. This contributes to lower cost of the apparatus without affecting the safety and the useful life of the apparatus. Thus, by appropriate shaping of the vessels, their interior can stand very substantial pressures even if the vessels are very long and have large diameters such as are necessary or desirable in order to equip the apparatus with one, two or more rows of discrete separators whereby each row can contain a large number of identical or differently dimensioned and/or configurated separators. It has been found that vessels which constitute elongated hollow cylinders of circular or polygonal outline, truncated cones or truncated pyramids can stand elevated internal pressures even if they consist of a very thin metallic sheet stock.

Figure 13:
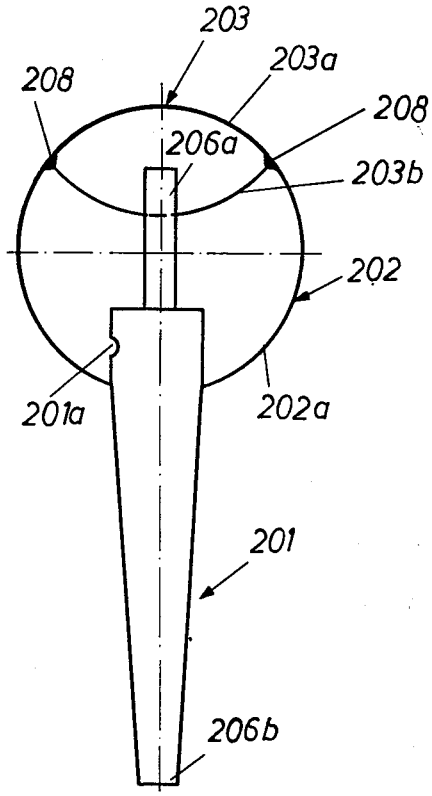
FIG. 13 is a schematic transverse vertical sectional view as seen in the direction of arrows from the line XIII—XIII of FIG. 12.
Figure 12:
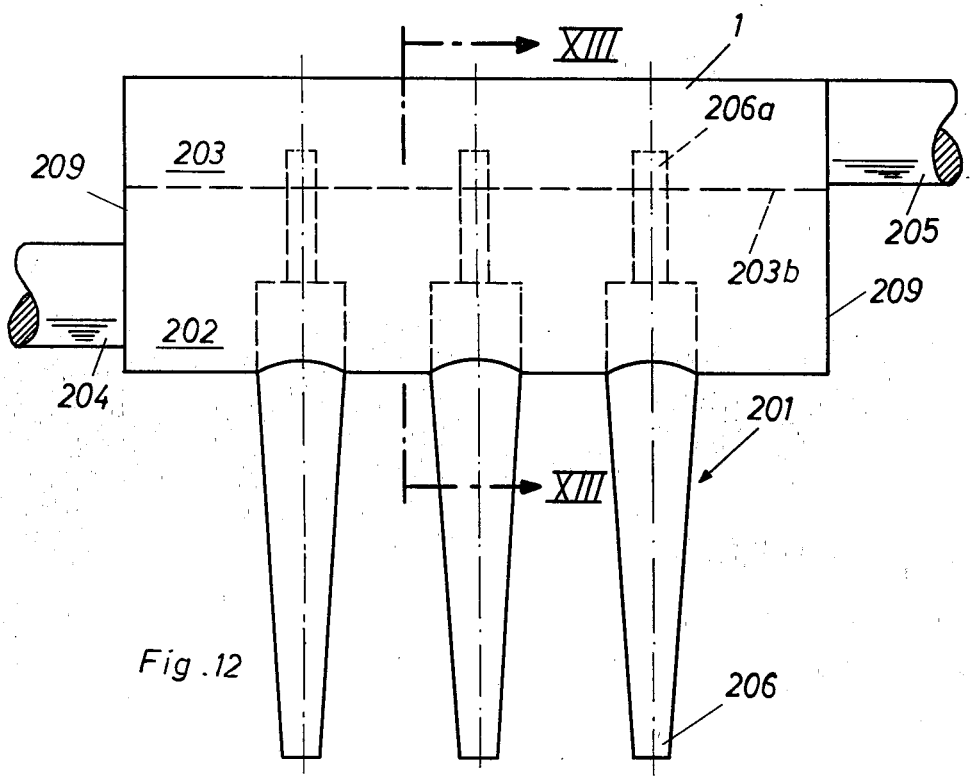
FIG. 12 is a fragmentary schematic side elevational view of an additional apparatus.

FIGS. 12 and 13 show a further apparatus having a lower vessel 202, an upper vessel 203 and a row of separators 201. The upper vessel 203 is recessed into the lower vessel 202 so that the exposed portions 202*a*, 203*a* of the shells of the two vessels together constitute a circular cylinder having a constant diameter. The axes of the two vessels are substantially or exactly parallel to but are spaced apart from each other. The manner in which the separators 201 are detachably connected to the vessel 202 and/or 203 is preferably the same as or analogous to that described in connection with the embodiments of FIGS. 1 to 11. The suspension is admitted into the lower vessel 202 via pipe 204 to enter the separators 201 via tangential inlets 201*a*; heavier fraction is evacuated via outlets 206 of the separators 201, and the lighter fraction leaves the separators 201 via outlets 206*a* and is evacuated from the vessel 203 via pipe 205.

The upper vessel 203 has two mirror symmetrical halves whose symmetry plane is horizontal, as viewed in FIG. 13. The lower vessel 202 has two mirror symmetrical halves whose symmetry plane is vertical, as viewed in FIG. 13. The cross-sectional area of the vessel 203 is a relatively small fraction (not appreciably more than one half and normally less than one half) of the cross-sectional area of the lower vessel 202. The lower half 203*b* of the shell of the upper vessel 203 has a lowermost portion at a level above the center of curvature of the shell of the lower vessel 202. The radii of curvature of all arcuate portions of the vessels 202 and 203 may but need not be identical.

The vessels 202, 203 of the apparatus of FIGS. 12 and 13 can be obtained by inserting an arcuate (203*b*) or flat partition into a cylindrical barrel which includes the upper half (203*a*) of the shell of the upper vessel 203 and the entire shell 202*a* of the lower vessel 202. Depending on the desired capacities of the chambers 202 and 203, the partition may be flat or arcuate, and the concave side of an arcuate partition can face the interior of the vessel 203 (as shown in FIGS. 12 and 13) or the interior of the vessel 202 (in the latter instance, the radius of curvature of the upper half of the shell of the vessel 203 is smaller than the radius of curvature of the lower half of such shell). The longitudinal marginal portions of the partition (such as 203*b*) are welded to the barrel including the parts 202*a* and 203*a*, as at 208. The end portions of the partition are welded to the end walls 209 of the barrel 202*a*, 203*a*.

An advantage of the apparatus of FIGS. 12 and 13 is that it can be manufactured at a low cost. Thus, and as described above, the chambers 202, 203 can be obtained by the simple expedient of inserting a flat, arcuate or otherwise configurated partition into a cylindrical barrel preferably consisting of sheet metal.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for segregating lighter and heavier fractions of a suspension, particularly for segregating relatively lightweight fibers from heavier impurities, comprising first and second elongated vessels having substantially parallel discrete longitudinal axes, said vessels including shells and the shell of one of said vessels and a portion of the shell of the other of said vessels together constituting a cylindrical barrel; means for connecting said vessels to each other; means for admitting the suspension into said first vessel at an elevated pressure; at least two discrete centrifugal separators each having a substantially tangenial inlet in communication with said first vessel, a first outlet for the lighter fraction in communication with said second vessel and a second outlet for the heavier fraction; means for evacuating the lighter fraction from said second vessel; and means for detachably securing said separators to said vessels.

2. Apparatus as defined in claim 1, wherein said second outlets are disposed substantially centrally of the respective separators and extend outwardly from said first vessel.

3. Apparatus as defined in claim 1, wherein at least a portion of each of said vessels has a circular cross-sectional outline.

4. Apparatus as defined in claim 1, wherein said connecting means comprises weldants.

5. Apparatus as defined in claim 1, wherein one of said vessels has a portion which extends into the other of said vessels.

6. Apparatus as defined in claim 1, further comprising a suction pipe having an inlet communicating with said second vessel.

7. Apparatus as defined in claim 1, wherein at least one of said vessels consists of sheet metal.

8. Apparatus as defined in claim 1, wherein said first vessel has first openings for portions of said separators and said second vessel has second openings for the first outlets of said separators, said portions of said separators including the respective inlets.

9. Apparatus as defined in claim 1, wherein said first vessel is constructed and assembled to withstand internal pressures higher than said second vessel.

10. Apparatus as defined in claim 1, wherein the diameter of said barrel is constant.

11. Apparatus as defined in claim 1, wherein the shell of said other vessel further comprises a second portion which is disposed in the interior of said barrel and separates said vessels from each other.

12. Apparatus as defined in claim 11, wherein said second portion of said last mentioned shell includes a concave side and a convex side and has a radius of curvature which is identical with the radius of said barrel.

13. Apparatus as defined in claim 1, wherein said separators form a single row.

* * * * *